US011946176B2

(12) United States Patent
Deloge et al.

(10) Patent No.: US 11,946,176 B2
(45) Date of Patent: Apr. 2, 2024

(54) KNITTED DEVICE WITH LOOPS, IN PARTICULAR FOR FORMING THE FEMALE PART OF A SELF-ADHESIVE FASTENER FOR ATTACHING A MOTOR VEHICLE SEAT COVER

(71) Applicant: APLIX, Le Cellier (FR)

(72) Inventors: Virginie Francette Nicole Deloge, Le Cellier (FR); Nathalie Christine Michèle Marie Moinard, Le Cellier (FR); Laurent Jean Michel Torlay, Le Cellier (FR)

(73) Assignee: Aplix, Le Cellier Relandières (FR)

( * ) Notice: Subject to any disclaimer, the term of this patent is extended or adjusted under 35 U.S.C. 154(b) by 283 days.

(21) Appl. No.: 17/601,598

(22) PCT Filed: Mar. 31, 2020

(86) PCT No.: PCT/EP2020/059071

§ 371 (c)(1),
(2) Date: Oct. 5, 2021

(87) PCT Pub. No.: WO2020/207856

PCT Pub. Date: Oct. 15, 2020

(65) Prior Publication Data

US 2022/0178055 A1 Jun. 9, 2022

(30) Foreign Application Priority Data

Apr. 8, 2019 (FR) ..... 1903735

(51) Int. Cl.
*D04B 21/02* (2006.01)

(52) U.S. Cl.
CPC ..... *D04B 21/02* (2013.01); *D10B 2403/0112* (2013.01); *D10B 2403/0311* (2013.01); *D10B 2505/08* (2013.01)

(58) Field of Classification Search
CPC ..... D04B 21/02; D04B 21/04; D04B 21/20; D04B 21/202; D04B 21/205;
(Continued)

(56) References Cited

U.S. PATENT DOCUMENTS 4,338,800 A * 7/1982 Matsuda ..... D04B 35/34 66/196
4,624,116 A * 11/1986 Rogers ..... D04B 21/02 66/193
(Continued)

FOREIGN PATENT DOCUMENTS

EP 0589395 A1 3/1994
EP 0682889 A1 11/1995
(Continued)

OTHER PUBLICATIONS

International Search Report dated Jun. 19, 2020 in related application No. PCT/EP2020/059071.

*Primary Examiner* — Danny Worrell
(74) *Attorney, Agent, or Firm* — Renner, Kenner, Greive, Bobak, Taylor & Weber

(57) ABSTRACT

Knitted device (5), in particular a knitted fabric, comprising a first area (6), in particular a rectangular area, from which loops (9) project and at least one second area (7, 8), in particular a contiguous rectangular area, preferably two contiguous areas (7, 8) on either side of the first area (6), the second contiguous border area(s) not including loops (9) and being designed to allow the knitted device to be attached to a cover (4) designed to cover a molded object (1), in particular a motor vehicle seat, for example by stitching, while the first area (6) with loops (9) is designed to cooperate with hooks (14) that project from the molded object (1), characterized in that means are provided to prevent or
(Continued)

combat the fraying of the threads of the knitted device (5) forming the one or more second border areas (7, 8).

20 Claims, 6 Drawing Sheets
(5 of 6 Drawing Sheet(s) Filed in Color)

(58) Field of Classification Search
CPC .... D10B 2403/0111; D10B 2403/0112; D10B 2501/0632
See application file for complete search history.

(56) References Cited

U.S. PATENT DOCUMENTS 4,677,011 A * 6/1987 Matsuda ..... A44B 18/0034 428/95
4,705,710 A * 11/1987 Matsuda ..... D04B 1/04 428/95
4,709,562 A * 12/1987 Matsuda ..... A44B 18/0034 66/193
4,739,635 A * 4/1988 Conley ..... A44B 18/0034 66/190
4,770,917 A * 9/1988 Tochacek ..... B32B 5/02 442/388
4,838,044 A * 6/1989 Matsuda ..... D04B 21/02 66/190
4,858,447 A * 8/1989 Matsuda ..... D04B 21/18 66/193
5,125,246 A * 6/1992 Shytles ..... D04B 21/18 66/193
5,214,942 A * 6/1993 Peake, III ..... D04B 21/04 24/445
5,373,712 A * 12/1994 Yamamoto ..... A44B 18/0034 24/450
5,520,021 A * 5/1996 Clerici ..... D04B 21/02 66/193
5,664,441 A * 9/1997 Clerici ..... D04B 21/02 66/193
5,736,214 A * 4/1998 Billarant ..... A44B 18/0034 66/192
6,018,852 A * 2/2000 Coslovi ..... A44B 18/0038 24/304
6,705,132 B1 * 3/2004 Hajek ..... A44B 18/0034 66/194
2011/0305864 A1 * 12/2011 Masuda ..... B68G 7/12 428/86
2012/0133194 A1 * 5/2012 Takehara ..... B60N 2/5825 24/450
2014/0283343 A1 * 9/2014 Okawa ..... D04B 21/02 24/449

FOREIGN PATENT DOCUMENTS

EP 0777006 A1 6/1997
FR 3003578 A1 9/2014

* cited by examiner

[Fig. 1]
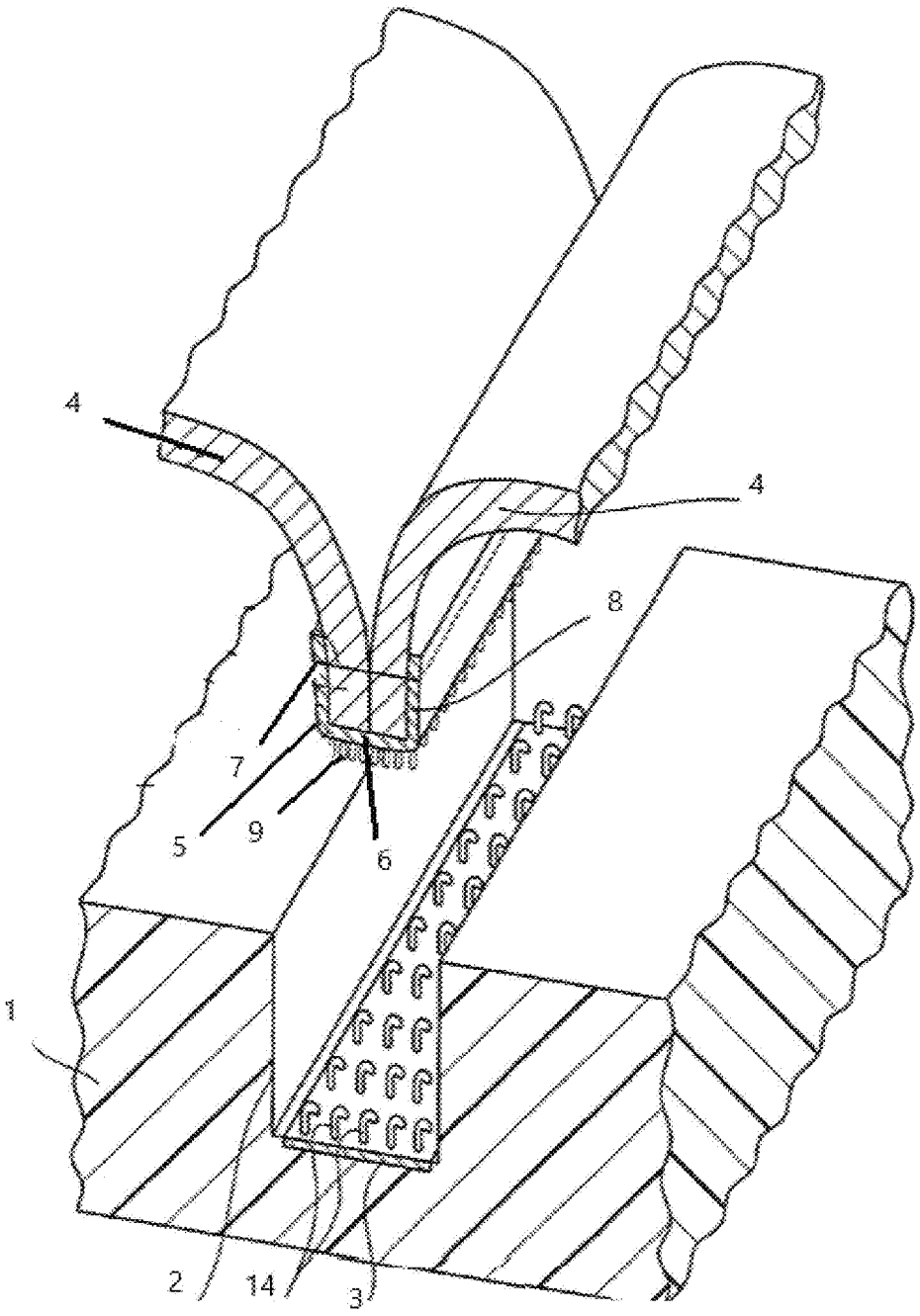

[Fig. 2]
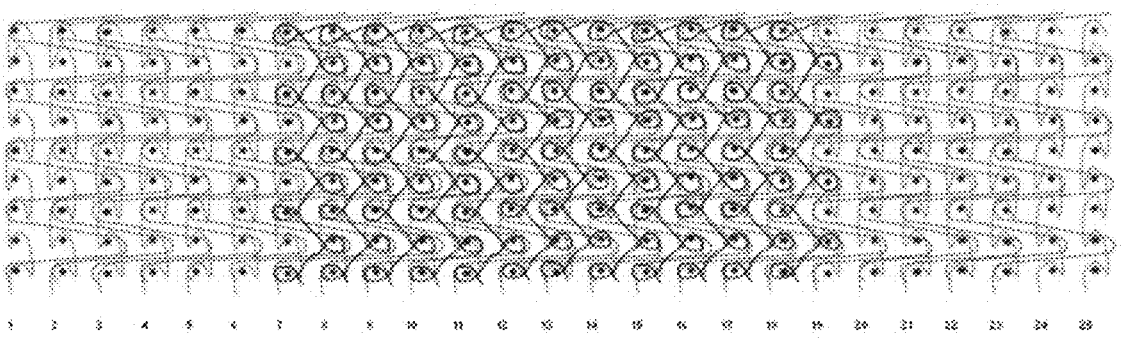
[Fig. 3]
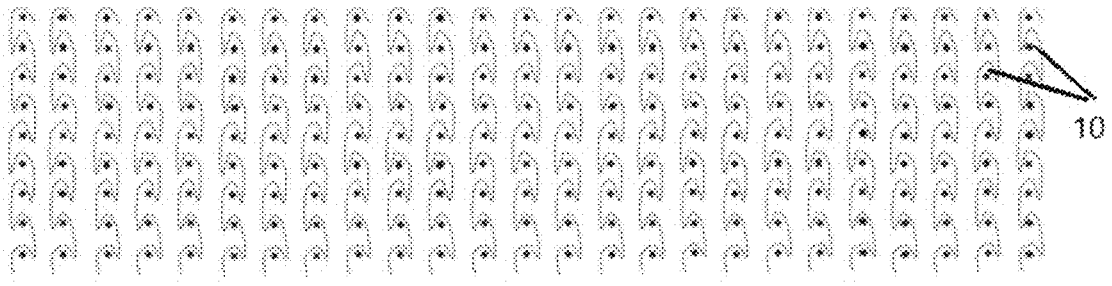
[Fig. 4]
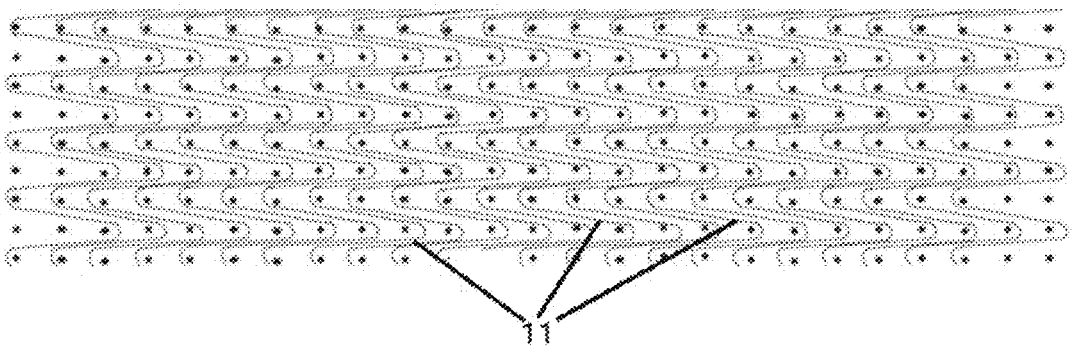

[Fig. 5]
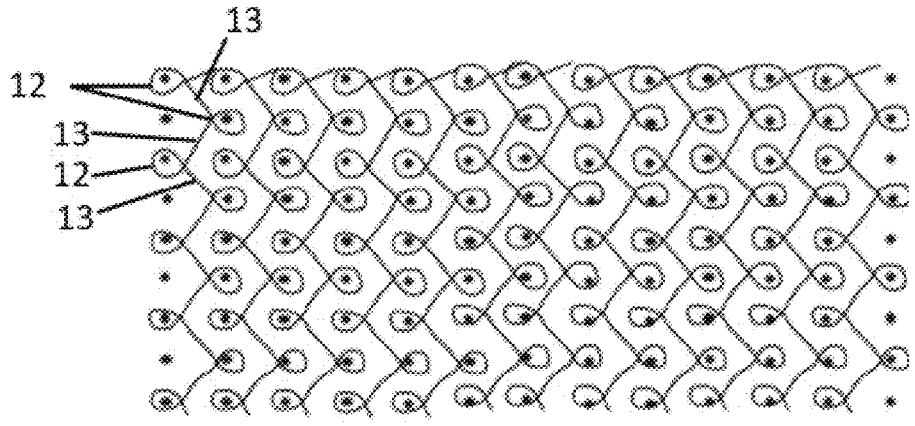
[Fig. 6]
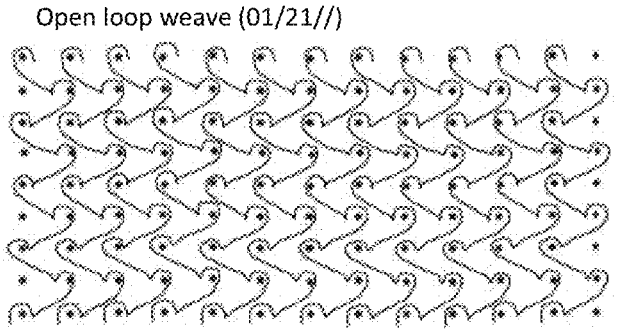
[Fig. 7]
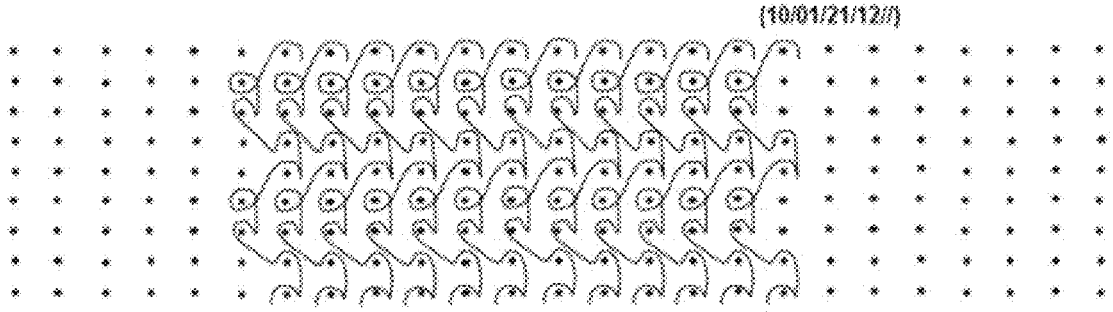

[Fig. 8]
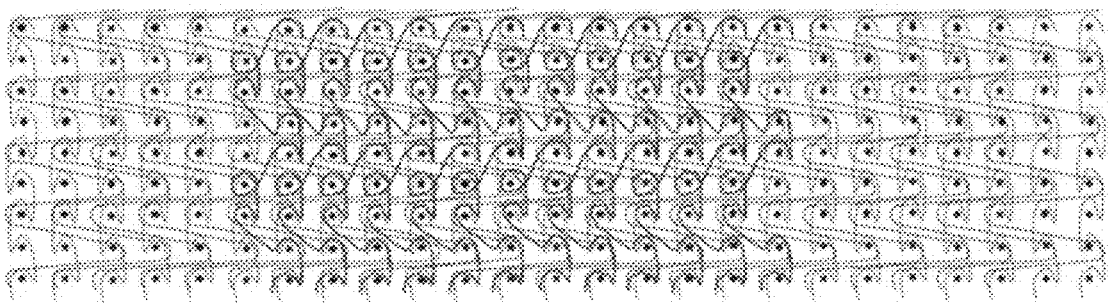
[Fig. 9]
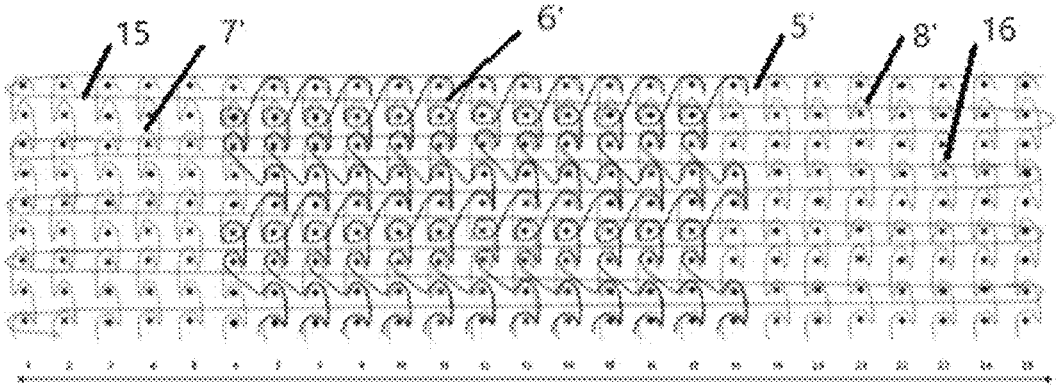

[Fig. 10]
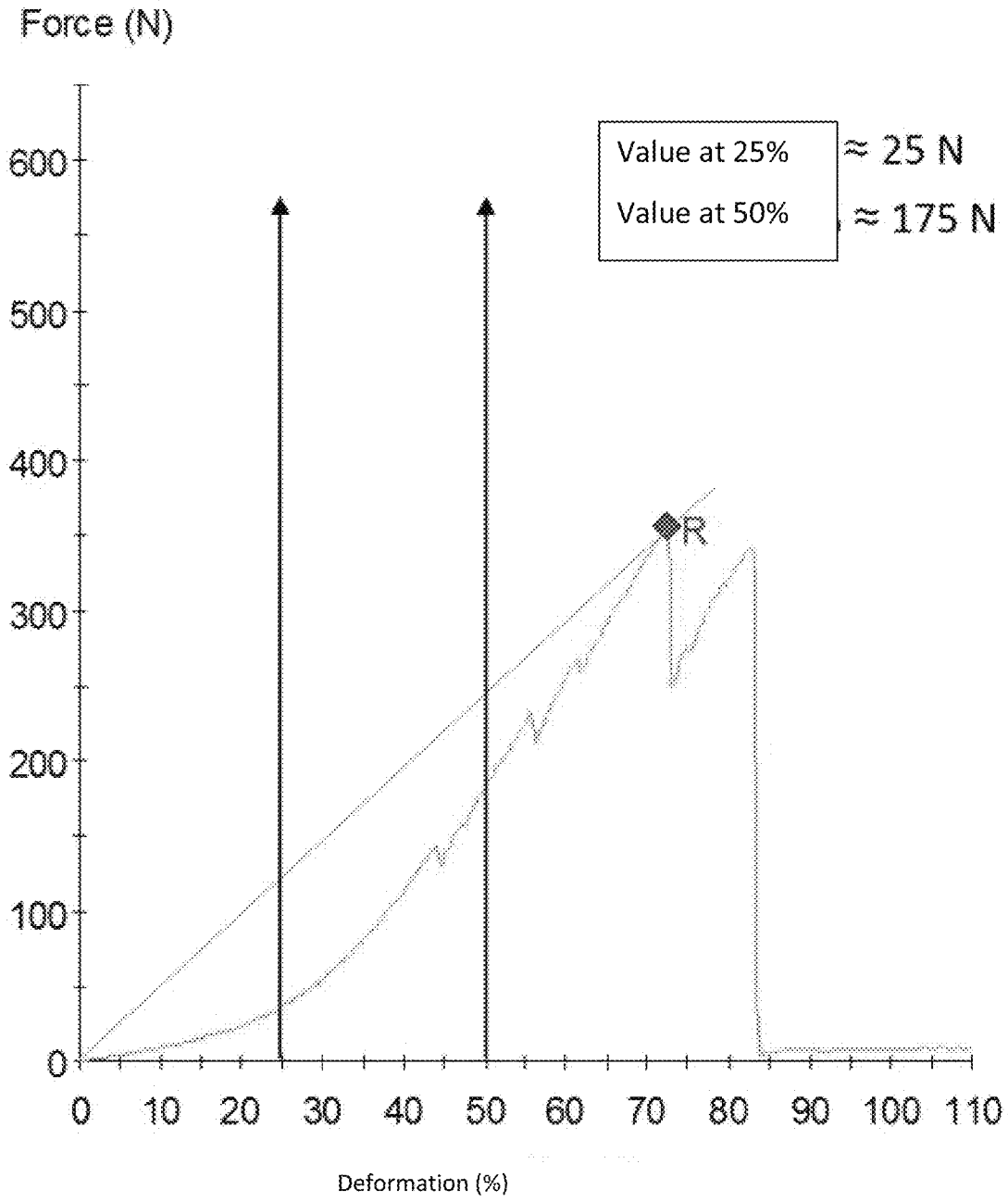

[Fig. 11]
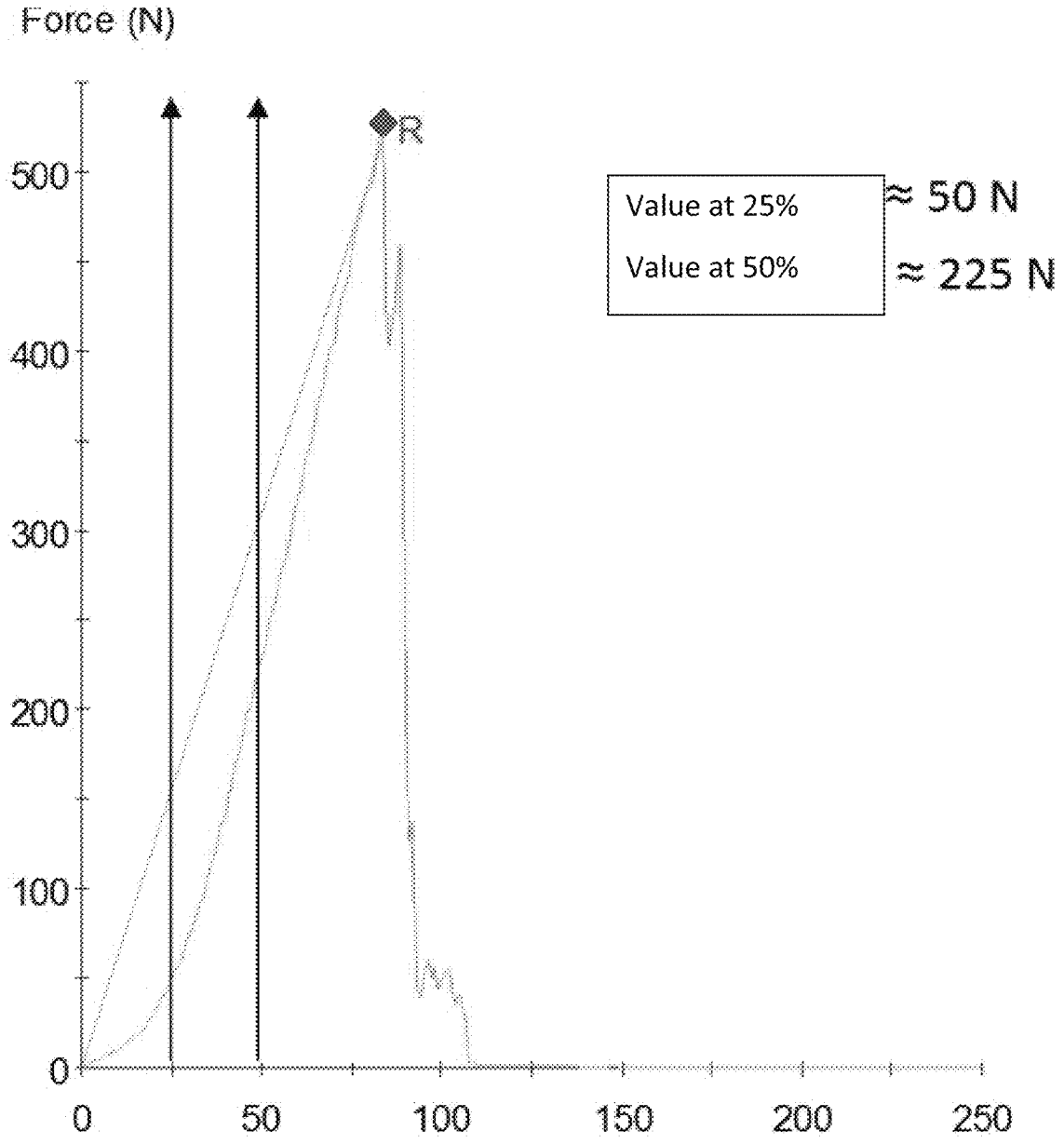

KNITTED DEVICE WITH LOOPS, IN PARTICULAR FOR FORMING THE FEMALE PART OF A SELF-ADHESIVE FASTENER FOR ATTACHING A MOTOR VEHICLE SEAT COVER

TECHNICAL FIELD

The present invention relates to a knitted device, in particular a knitted mesh, with adhesive loops, comprising a first area, in particular a central area, comprising loops designed to cooperate with hooks associated with a hook element and at least one second selvedge area, in particular two second selvedge areas on either side of the first central loop area, which is contiguous with the first loop area and does not comprise any loops. The present invention also relates to a cover designed to cover a foam object produced by moulding, for example a motor vehicle seat, the cover comprising, on its face which is designed to be in contact with the moulded object, a knitted device with loops of the type mentioned previously, the knitted device with loops being attached, in particular stitched, to the cover, in particular in the region of the at least one second selvedge area. The present invention also relates to a moulded object, for example a motor vehicle seat, covered with a cover of this type.

BACKGROUND

Traditionally, in order to produce a motor vehicle seat, in the first instance, foam is moulded in the form of the seat to be produced and, during moulding, hooks are over-moulded such that they project from the bottom of cavities or trenches formed on the outer surface of the moulded object to allow a cover to be attached around the object by means of loops projecting from the cover.

These loops are produced by means of a knitted device with loops comprising, in general terms, a central area, from which knitted loops project, and two selvedge areas, on the left and right, from which knitted loops do not project and in which regions the knitted device with loops is attached to the cover, in particular by stitching, to allow said cover to be attached to the moulded object by means of the hooks over-moulded on the moulded object.

This type of moulded object covered by a cover, in particular a motor vehicle seat, is known in the prior art, for example in document FR 3 003 578 A1.

Such motor vehicle seats covered by a cover, particularly in the form of a textile fabric or leather, must look as neat and precise as possible. In order to do this, the cover should fit perfectly with the contours of the moulded object that it is covering. In practice, covers are observed to be either badly attached to moulded objects and, in particular, do not form a perfect fit around the shape of the moulded object, notably the motor vehicle seat, that they are intended to cover, or, as part of a gradual process over time, they no longer fit the shape of the seat perfectly.

It would be desirable to overcome the disadvantages described above and achieve a motor vehicle seat covered by a cover attached to said seat by means of a self-adhesive system of hooks and loops in which the cover fits the contours of the moulded object perfectly and continues to fit in this manner over the long term.

SUMMARY OF THE INVENTION

According to the invention, a knitted device, in particular a knitted mesh, comprising a first area, in particular a rectangular area, from which loops project and at least one second area, in particular a contiguous rectangular area, preferably two contiguous areas on either side of the first area, the second contiguous selvedge area(s) not comprising loops and being designed to allow the knitted device to be attached to a cover designed to cover a moulded object, in particular a motor vehicle seat, for example by stitching, while the first area with loops is designed to cooperate with hooks that project from the moulded object, the knitted fabric comprising a back formed by interweaving loop wale threads, or columns of stitches, and weft threads, and, in the first area of loop threads knitted in the back, each loop being formed by two knitted legs in the back, two strands leaving the two legs and a top connecting the two strands, is characterised in that means are provided to prevent or combat fraying of the threads of the knitted device forming the one or more second selvedge areas.

In particular, means for preventing or combating fraying of the threads are arranged across the entire width of the one or more second selvedge areas.

By thus providing means to combat fraying of the threads forming the selvedges, it is possible to ensure, particularly in the long term, that the covers are attached perfectly to the moulded objects without experiencing any slippage due to deterioration of the selvedges over time due to the stresses they may experience on the one hand due to how they are attached, in particular by stitching, and, on the other hand, due to the hooks being attached to the loops, and due to the stresses experienced by the cover during use. An adhesive loop is understood to be a loop that projects from the plane formed by the back of the knitted fabric and/or a loop extending in a different plane to the back of the knitted fabric.

In an advantageous embodiment of the invention, which is particularly robust, the means of preventing or combatting fraying entail covering the selvedge area(s) with a coating, for example a resin or glue, which, after hardening, gives the selvedges considerable dimensional stability and thus prevents fraying.

In another, equally advantageous embodiment of the invention, which, in particular, simplifies the process for manufacturing the final covered seat, and thus reduces the costs associated with manufacture, the knitted device is a knitted fabric comprising a back formed by interweaving loop wale threads, or columns of stitches, and weft threads, and, in the first central area of loop threads knitted in the back, each loop being formed by two knitted legs in the back, two strands leaving the two legs and a top connecting the two strands, the weft threads of the back extending in a back-and-forth movement in a crosswise direction so as to zigzag around, in the machine direction, a number N of rows of columns of stitches where N is between 2 and 5, in particular 3 rows, and this applies across the entire transverse extent of the back, with the exception of a number N−1 of successive end rows of columns of stitches, in particular a number N−1 of last rows.

The distance in CD between two consecutive weft threads is between 75% and 125% of the distance, in CD, between two consecutive warp threads.

The weft threads on the back extending in a zigzag back-and-forth movement, two contiguous weft threads on the back are substantially parallel, and in particular the zigzag shape of the two contiguous weft threads on the back is such that a point of the zigzag shape of a first weft thread and a point of the zigzag shape of a second weft thread forms a segment extending substantially parallel to the CD direction.

The weft threads on the back extending in a zigzag back-and-forth movement, the distance in MD between two contiguous ends in MD of the same weft thread ranges between 0.5 mm and 5 mm, in particular between 0.8 mm and 3 mm, and more particularly of the order of 1.8 mm.

The weft threads on the back extending in a zigzag back-and-forth movement, the distance in CD between two contiguous ends in CD of the same weft thread ranges between 0.6 mm and 25 mm, in particular between 2 mm and 10 mm.

When N is equal to 2, the weft threads on the back extending in a zigzag back-and-forth movement, the distance in CD between two contiguous ends in CD of the same weft thread ranges between 0.6 mm and 10 mm, in particular between 2 mm and 4 mm, and more particularly of the order of 3 mm.

When N is equal to 3, the weft threads on the back extending in a zigzag back-and-forth movement, the distance in CD between two contiguous ends in CD of the same weft thread ranges between 1 mm and 15 mm, in particular between 3 mm and 6 mm, and more particularly of the order of 4.5 mm (or ⅕ of an inch).

When N is equal to 4, the weft threads on the back extending in a zigzag back-and-forth movement, the distance in CD between two contiguous ends in CD of the same weft thread ranges between 1.33 mm and 20 mm, in particular between 4 mm and 8 mm, and more particularly of the order of 6 mm.

When N is equal to 5, the weft threads on the back extending in a zigzag back-and-forth movement, the distance in CD between two contiguous ends in CD of the same weft thread ranges between 1.67 mm and 25 mm, in particular between 5 mm and 10 mm, and more particularly of the order of 7.5 mm.

Preferably, the segment connecting the two legs of a loop extends in the MD direction and in the CD direction, thus forming an angle in relation to the MD direction which is preferably between 10° and 80°, in particular between 30° and 75° in some cases. In some cases, the inclination changes from one loop to the next in the CD direction, in other words, the angle alternates between positive and negative.

Preferably, each loop is formed by two knitted legs in the back and each leg belongs to different contiguous columns, the zigzag shape is achieved after N rows of columns of stitches or picks, without float loops, in other words without missing a row of stitches.

By thus providing weft threads extending in a zigzag, for example over three rows of columns of stitches and across the entire width, it is possible to ensure that the selvedge areas do not fray. At the same time, compared with the first advantageous embodiment, this therefore not only combats fraying at a lower cost, in particular by being able to dispense with using less of an expensive coating material, such as a resin or glue, which then hardens, but also leads to a simplified manufacturing process with fewer stages.

The anti-fraying means are preferably used such that, when a curve is plotted to give the force needed to deform the knitted fabric in the crosswise direction (CD) as a function of the deformation between the origin of the coordinates (0, 0) and the breaking point R (which can be recognised by a sudden falling-off of the curve, for example a sudden change in force in excess of 10%, in particular more than 15%), the curve always remains beneath the straight line connecting the origin and point R.

In a preferred embodiment, the value of the force at 25% deformation is less than 150 N, preferably less than 125 N, even more preferably less than 100 N, and in particular less than 50 N, or even 35 N.

In a preferred embodiment, the value of the force at 50% deformation is less than 350 N, preferably less than 335 N, even more preferably less than 300 N, and in particular less than 225 N, or even 190 N.

In a preferred embodiment, the knitted fabric comprises a first central area with loops and two second contiguous selvedge areas on the left and right.

The knitted fabric is preferably produced on a three-bar loom, in particular a loom with three bars for distributing the thread and a jack bar.

The knitted fabric is preferably produced on a three-bar warp loom, in particular a loom with three bars for distributing the thread, and a jack bar.

The knitted fabric is preferably produced on a three-bar warp loom, one bar of which is a guide bar and the two other bars are tube bars.

The knitted fabric is preferably produced on a warp loom, in particular a crochet machine (for example a crochet machine marketed by COMEZ and/or Jakob Müller A G Frick under reference Comez 610 ACO, or, to be more specific, Comez 610 ACO-15).

In an advantageous embodiment per se, the loop weave is a 10/12// closed-stitch loop weave.

In another, equally advantageous embodiment per se, the loop weave is an open loop weave, notably a 01/21// weave.

The present invention also relates to a moulded object, for example a motor vehicle seat, comprising a block made from moulded material, in particular from foam, having the same shape as the object, in particular the motor vehicle seat, and a cover covering the block, the cover being attached to the block by cooperation between hooks, in particular a plurality of areas of hooks protruding from the outer surface of the moulded object, and loop knitted fabrics according to the invention, which are attached, in particular stitched, to the cover, in particular on the lower face of the cover.

The materials used for the weft, loop and warp threads may be identical or different from one another and may be selected from, for example, polyethylene terephthalate (PET), polypropylene (PP), aramide, polyamide (PA), polyethylene (PE) or similar, as well as blends of the above. Elastic or elastomer and/or thermobonding materials may also be used. The yarns may be flat, textured, gimped and/or twisted. The materials used for the weft, loop and warp threads may be identical or different types made from a single-component or two-component material or a material with multiple components.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

By way of example, a preferred embodiment of the invention will now be described with reference to the drawings in which:

FIG. 1 is a schematic perspective view of a moulded object in which the cover covering said object is shown at a distance from the moulded object;

FIG. 2 shows a theoretical knitted weave of all threads to be used in the device in FIG. 1, in particular the knitted fabric stitched to the cover in FIG. 1;

FIG. 3 shows a theoretical knitted weave showing only the warp threads or loop wale threads of the knitted fabric in FIG. 2;

FIG. 4 shows a theoretical knitted weave showing only the weft threads of the knitted fabric in FIG. 2;

FIG. 5 shows a theoretical weave showing only the loops of the knitted fabric in FIG. 2;

FIG. 6 shows a second embodiment of the loop weave;

FIG. 7 shows a second embodiment of the loop weave;

FIG. 8 shows a theoretical knitted weave according to an embodiment using the weft weaves in FIG. 4, the columns of stitches in FIG. 3 and the loops in FIG. 7.

FIG. 9 shows a knitted fabric according to yet another embodiment of the invention;

FIG. 10 shows the curve giving the force needed to deform a knitted fabric according to the invention, in other words a knitted fabric comprising the weft threads in FIG. 4, the loop wale threads in FIG. 3 and the so-called open/closed loop threads in FIG. 7 as a function of deformation, particularly between the origin point (0, 0) and the breaking point R, and FIG. 11 shows the curve giving the force needed to deform a knitted fabric according to the invention, in other words a knitted fabric comprising the weft threads in FIG. 4, the loop wale threads in FIG. 3 and the loop threads in FIG. 5 or FIG. 6 as a function of deformation, particularly between the origin point (0, 0) and the breaking point R.

DETAILED DESCRIPTION OF THE INVENTION

FIG. 1 shows a moulded object in the form of a motor vehicle seat comprising a block 1 made from foam, in particular polyurethane, having the form of a motor vehicle seat and comprising a plurality of trenches 2 at the bottom of which a rectangular strip 3 with hooks 14 to be overmoulded has been attached, in particular by insertion prior to moulding. The moulded object, i.e. the motor vehicle seat, is covered with a cover 4, which perfectly fits the external surface of the block 1. In order to achieve this, the cover 4 is stitched to a knitted device 5, which comprises a central area 6, from which knitted loops 9 project, and two selvedge areas 7 and 8, each of which are stitched to the lower face of the cover 4. When the loops cooperate with the hooks, the cover 4 is attached around the moulded block, fitting its shape perfectly. This thus leads to a moulded object covered with its final cover, for example a motor vehicle seat.

FIGS. 2 to 5 show the weave of a loop knitted fabric produced on a warp loom, which entails working with three guide and tube bars. A first guide bar is used to form loop wales or columns of stitches 10 which cooperate with each row (vertical in the figures) of needles. The second tube bar is used to form weft connections 11 which cooperate with the needles for forming the loop wales 10. A third tube bar is used to form stitches 12 (the legs of the loops) on all needles on a jack bar in the central part of the knitted fabric (rows 7 to 19). The loop thread thus forms the tops 13 of the loops.

The weft connections (FIG. 4) are shown by a non-meshed (weft) system 10. The loop wales, or columns of stitches, may be open or alternate.

Each weft thread, as shown in FIG. 4, extends according to a 00/33// weave. Thus, each weft thread extends in a zigzag in the machine direction (vertical in the figures), passing around three needles of three successive rows in the crosswise direction (from left to right on FIG. 4). In addition, all the rows of needles are thus circumvented/blocked/included in the zigzag by the weft threads, with the exception of the last two columns (24 and 25) which are circumvented/blocked/included in the zigzag by the weft threads on one occasion out of two, and across the entire back of the knitted fabric (rows 1 to 23). Thus, the number of weft threads is equal to the number of rows of columns of stitches minus two. The weft threads are offset by one column. In the event that the zigzag is not formed around three rows, but rather two rows, the number of weft threads is equal to the number of rows of columns of stitches minus one. In general terms, for a zigzag of weft threads formed around N needles (where N is between 2 and 5), the number of weft threads is equal to the number of rows of columns of stitches minus N plus 1. The zigzag extends in the MD direction and is formed on each row of stitches.

25 columns of needles are shown on the figures. A different number of columns of needles may also be provided depending on the final width of the desired product. FIG. 2 shows how the bar of the columns of stitches works. This is a traditional operation and is not described any further here. The weft weave is shown in FIG. 4. Each weft thread extends in a zigzag around three needles, each zigzag weft thread extends directly after the preceding weft thread. There are thus as many weft threads as columns of stitches or columns of needles, with the exception of the final two columns, which are circumvented/blocked/included in the zigzag on one occasion out of two.

The loop weave shown in FIG. 5 is a closed-stitch loop weave 10/12//.

According to another embodiment shown in FIG. 6, the loop weave is an open loop weave, notably a 01/21// weave.

According to another possible embodiment of the loop weave, a so-called open/closed loop weave is produced, notably a 10/01/21/12// weave.

According to the invention, it is provided that all weft threads extend in a zigzag around three needles and by ensuring that the weft threads extend in succession directly after one another without being separated by a column of stitches or loop wales without any weft.

In addition, the knitted fabric has preferably been produced using only three thread bars. However, the knitted fabric could equally well be produced using a fourth thread distribution bar to produce a weft in the opposite direction, for example an identical weft to that shown in FIG. 4, or, alternatively, a weave with fewer wefts, for example such that one loop wale out of two does not have a weft, or even two loop wales out of three or three loop wales out of four. However, the knitted fabric is preferably produced using only three bars.

In addition, instead of forming a zigzag around three needles, the zigzag could be formed around two needles, and, preferably, between two and five needles. Preferably, 25 columns of needles are provided, and in particular 25 warp threads for a knitted fabric with a width of 40 mm.

Another embodiment of the invention is shown in FIG. 9. The knitted fabric 5' with loops comprises a central area 6' and two selvedge areas 7' and 8'. The knitted fabric 5' consists of a back formed by interweaving weft threads and threads with columns of stitches, and, in the central part, loop threads knitted to form loops. The back may be as described previously or may alternatively be different, namely, for example, weft threads which extend in a zigzag across the entire width of the back (as shown on FIG. 9) or over a number of rows in excess of 5. Weft threads may also be provided that do not extend in succession across the entire width of the knitted fabric, for example, by leaving one row out of two or one row out of three without a weft thread. On the other hand, in order to combat fraying, which is likely to arise due to this weft structure, according to the invention it is provided that the selvedge areas may be coated with a hardening glue or resin which will thus protect the knitted fabric from fraying when said fabric undergoes stresses related to the action of hooks on the area with loops on the one hand, and stresses caused by the user.

In particular, it is possible to use a resin that allows mechanical anchoring, for example high-viscosity hot melt adhesive (HMA), for example based on SBC (Styrene Bloc Copolymer), based on polyolefin (PO), based on polyurethane (PU) and/or chemical anchoring. As a variation to FIG. 9, as an alternative or in addition to the layers of resins 15 and 16 with which the selvedges are coated, a thermal stage could be performed, for example by calendering and/or by ultrasonic welding in the selvedge areas to reinforce them and combat fraying which is likely to arise due to this weft structure.

In the embodiments in FIGS. 1 to 8, the anti-fraying means are formed by the defined structure of the background wefts. In FIG. 9, these anti-fraying means are formed by the coating and, in particular, the layers of resins 15 and 16 with which the selvedges are coated. It is thus possible to choose between these two methods in the knowledge that coating is more expensive and more complex to apply. If desired, it is also possible to combine the methods by coating the selvedges of the knitted fabrics in FIGS. 1 to 8 to achieve an even better anti-fraying effect.

FIGS. 10 and 11 shows the curve giving the force needed to deform knitted fabrics in the crosswise direction (CD) according to the invention as a function of the deformation. This curve is traditionally obtained using a dynamometer, in particular by applying the method described in Standard NF EN1415, using the elongation at break test in the CD direction, which entails placing a sample of the knitted fabric between two jaws (distance between the jaws equal to 20 mm) of a dynamometer (traction speed 100 mm/min).

As shown in FIGS. 10 and 11, between the origin of the coordinates (0, 0) and the breaking point R (which can be recognised by a sudden falling-off of the curve, for example a drop in the value of the force in excess of 10%, in particular in excess of 15%), the curve still remains beneath the straight line connecting the origin and point R.

According to the invention, the value of the force at 25% deformation is less than 150 N, preferably less than 125 N, even more preferably less than 100 N, and in particular less than 50 N, or even 35 N.

According to the invention, the value of the force at 50% deformation is less than 350 N, preferably less than 335 N, even more preferably less than 300 N, and in particular less than 225 N, or even 190 N.

As a variation to the embodiment in FIG. 2, loops as shown in FIG. 6 or 7 could be used, for example.

As a variation to the embodiment in FIG. 9, a coating could be used as shown in FIG. 9 and/or a thermal stage could be performed on the selvedges, for example calendering and/or ultrasonic bonding to combat fraying even further.

As a variation to the embodiments in FIGS. 2 to 8, loops as shown in FIG. 5 or 6 could be used, for example.

The invention claimed is:

1. Knitted device, comprising a knitting fabric having a first area from which loops project and at least one second selvedge area the at least one second selvedge area not comprising loops and being designed to allow the knitted device to be attached to a cover designed to cover a moulded object while the first area with loops is designed to cooperate with hooks that project from the moulded object, the knitted fabric comprising a back formed of interweaving loop wale threads, or columns of stitches, and connecting threads in the weft direction, and, in the first area, of loop threads knitted in the back, each loop being formed by two knitted legs in the back, two strands leaving the two legs and a top connecting the two strands, wherein means are provided to prevent or combat fraying of the threads of the knitted device forming the at least one second selvedge area; and wherein the connecting threads in the weft direction of the back extend in a back-and-forth movement in a transverse direction so as to at least circumvent, block or form a zigzag around, in the machine direction, a number N of rows of columns of stitches where N is between 2 and 5, and this applies across the entire transverse extent of the back of each of the at least one second selvedge area, with the exception of a number N-1 of successive end rows of columns of stitches.

2. Knitted device according to claim 1, characterised in that the means to prevent or combat fraying entail covering the at least one second selvedge area with a coating which provides the at least one second selvedge area considerable dimensional stability and thus prevents fraying of said at least one second selvedge area.

3. Knitted device according to claim 1, characterised in that N is equal to 3.

4. Knitted device according to claim 1, characterised in that anti-fraying means are used such that, a curve giving a force needed to deform the knitted fabric in the crosswise direction (CD) as a function of the deformation between an origin of the coordinates (o, o) and a breaking point R which is at a sudden falling-off of the curve, always remains beneath a straight line connecting the origin and said breaking point R.

5. Knitted device according to claim 4, characterised in that the value of the force at 25% deformation is less than 150 Newtons.

6. Knitted device according to claim 4, characterised in that the value of the force at 50% deformation is less than 350 Newtons.

7. Knitted device according to claim 1, characterised in that it comprises a first central area with loops and two second contiguous selvedge areas on the left and right.

8. Knitted device according to claim 1, characterised in that it is produced on a three-bar loom.

9. Knitted device according claim 1, characterised in that the loop weave is a 10/12// closed-stitch loop weave.

10. Knitted device according to claim 1, characterised in that the loop weave is a 01/21// open loop weave.

11. Moulded object comprising a block made from moulded material having the same shape as the object and a cover covering the block, the cover being attached to the block by cooperation between hooks protruding from the outer surface of the moulded object, and knitted devices according to claim 1 which are attached to the cover.

12. Knitted device, comprising a knitting fabric having a first area from which loops project and at least one second selvedge area, the at least one second selvedge area not comprising loops and being designed to allow the knitted device to be attached to a cover designed to cover a moulded object, while the first area with loops is designed to cooperate with hooks that project from the moulded object, the knitted fabric comprising a back formed of interweaving loop wale threads, or columns of stitches, and connecting threads in the weft direction, and, in the first area, of loop threads knitted in the back, each loop being formed by two knitted legs in the back, two strands leaving the two legs and a top connecting the two strands, wherein means are provided to prevent or combat fraying of the threads of the knitted device forming the at least one second selvedge area; and wherein said knitted fabric is produced on a three-bar loom.

13. Moulded object comprising a block made from moulded material having the same shape as the object and a cover covering the block, the cover being attached to the block by cooperation between hooks protruding from the outer surface of the moulded object, and knitted devices according to claim 12 which are attached to the cover.

14. Knitted device according to claim 4, characterised in that the value of the force at 25% deformation is less than 125 Newtons.

15. Knitted device according to claim 4, characterised in that the value of the force at 25% deformation is less than 100 Newtons.

16. Knitted device according to claim 4, characterised in that the value of the force at 25% deformation is less than 50 Newtons.

17. Knitted device according to claim 4, characterised in that the value of the force at 25% deformation is less than 35 Newtons.

18. Knitted device according to claim 4, characterised in that the value of the force at 50% deformation is less than 300 Newtons.

19. Knitted device according to claim 4, characterised in that the value of the force at 50% deformation is less than 225 Newtons.

20. Knitted device according to claim 4, characterised in that the value of the force at 50% deformation is less than 190 Newtons.

* * * * *